US012378761B2

(12) United States Patent
Stapleton

(10) Patent No.: US 12,378,761 B2
(45) Date of Patent: Aug. 5, 2025

(54) EXPANDABLE PORTABLE SHELTER AND STRUCTURES OF MULTIPLE EXPANDABLE PORTABLE SHELTERS

(71) Applicant: GrowTech Industries, LLC, Buffalo, NY (US)

(72) Inventor: Richard H. Stapleton, Buffalo, NY (US)

(73) Assignee: GTI IP Corp., Buffalo, NY (US)

( * ) Notice: Subject to any disclaimer, the term of this patent is extended or adjusted under 35 U.S.C. 154(b) by 0 days.

(21) Appl. No.: 17/502,657

(22) Filed: Oct. 15, 2021

(65) Prior Publication Data

US 2023/0120060 A1 Apr. 20, 2023

(51) Int. Cl.

| | |
|---|---|
| ***E04B 1/348*** | (2006.01) |
| ***E04B 1/344*** | (2006.01) |
| ***E04H 1/12*** | (2006.01) |

(52) U.S. Cl.

CPC ..... *E04B 1/3483* (2013.01); *E04B 1/3442* (2013.01); *E04H 1/1205* (2013.01); *E04H 2001/1283* (2013.01)

(58) Field of Classification Search

CPC .... E04B 1/3442; E04B 1/343; E04B 1/34357; E04B 1/34384; E04B 1/344;

(Continued)

(56) References Cited

U.S. PATENT DOCUMENTS 3,643,390 A * 2/1972 Shelley ..... E04B 1/34823 52/234
4,588,652 A * 5/1986 Reynard ..... B23K 31/02 228/175

(Continued)

FOREIGN PATENT DOCUMENTS

AU 2009317833 A1 5/2010
AU 2013351917 B2 8/2017

(Continued)

OTHER PUBLICATIONS

Email from website; CMCI; Tricon Expandable Container; Jul. 16, 2021.

(Continued)

*Primary Examiner* — Brian E Glessner
*Assistant Examiner* — Adam G Barlow
(74) *Attorney, Agent, or Firm* — Simpson & Simpson, PLLC; Jeffrey B. Powers

(57) ABSTRACT

A multicon structure comprising six or twelve expandable portable shelters (EPSs) characterized by equal depth dimensions extending in the direction of the structure length, and each EPS having two faces that are transverse to the structure length. Each EPS comprises two sets of panels, each set of panels including a floor panel, a ceiling panel, side panels, and an end panel. Each set of panels folding out from a corresponding face. Each EPS may be characterized by a depth that is a unit fractional amount of an intermodal shipping container length. Each EPS having corner post assemblies comprising a tubular stiffening structure, a hinge mount feature, and a panel interface feature. The outer panel having a gasket positioned such that, when the EPS is in a collapsed state, a watertight seal is formed between the gasket and the panel interface feature.

25 Claims, 6 Drawing Sheets

(58) Field of Classification Search
CPC ..... E04B 1/3445; E04B 2001/34389; E04B 1/3441; E04H 1/1205
USPC ..... 52/66, 68, 69, 71, 79.5, 204.1, 210, 213, 52/215
See application file for complete search history.

(56) References Cited

U.S. PATENT DOCUMENTS 4,656,797 A * 4/1987 Marquart ..... E04B 1/0007 52/592.1
4,726,158 A * 2/1988 Fagnoni ..... E04B 1/343 52/79.5
5,237,784 A 8/1993 Ros
5,243,794 A * 9/1993 Pikor ..... E04H 13/006 52/79.9
5,761,854 A * 6/1998 Johnson ..... B60P 3/34 52/79.5
5,966,956 A * 10/1999 Morris ..... E04B 1/3444 52/79.5
6,125,597 A * 10/2000 Hoffman ..... E04B 1/34352 52/293.3
6,135,525 A 10/2000 Amann
6,374,552 B1 * 4/2002 Price ..... E04B 2/06 52/779
6,453,627 B1 * 9/2002 Powers ..... E04B 1/34342 52/745.1
7,418,802 B2 9/2008 Sarine et al.
7,784,845 B2 8/2010 Kim et al.
7,874,107 B1 1/2011 Medley et al.
7,930,857 B2 4/2011 Pope
8,112,943 B2 2/2012 Medley et al.
8,141,304 B2 3/2012 Shen et al.
8,166,715 B2 5/2012 De Azambuja
8,347,560 B2 1/2013 Gyory et al.
8,622,066 B2 1/2014 Dolsby et al.
8,650,806 B1 * 2/2014 Condie ..... E04H 1/1205 52/79.5
8,695,285 B2 4/2014 Reinmann, Jr. et al.
8,707,633 B2 * 4/2014 Han ..... E04B 1/3442 52/79.5
8,720,126 B2 5/2014 Strickland et al.
8,875,445 B2 * 11/2014 Lippert ..... E04B 1/34838 52/79.2
9,067,721 B2 6/2015 Mullaney
9,080,326 B2 7/2015 Johnson et al.
9,121,617 B2 9/2015 Condie
9,258,930 B2 2/2016 Gardner et al.
9,410,339 B2 8/2016 Gardner et al.
9,429,341 B2 8/2016 Condie
9,458,621 B2 10/2016 Calafatis et al.
D793,578 S 8/2017 Rossi
9,970,207 B2 5/2018 Wasson
D820,469 S * 6/2018 Watson ..... D25/29
10,047,514 B2 8/2018 Sparks et al.
D829,925 S 10/2018 Labesque et al.
10,240,339 B1 3/2019 Dominguez
10,343,586 B2 7/2019 Stoetzl
D864,418 S 10/2019 Brown et al.
10,457,188 B1 10/2019 Mackay
10,464,465 B2 11/2019 Huntimer
10,519,647 B2 * 12/2019 Crozier ..... E04H 1/1205
10,590,671 B1 3/2020 Jee et al.
10,738,459 B2 8/2020 Brown et al.
10,865,942 B2 12/2020 Banerjee et al.
10,968,622 B2 4/2021 Klein
11,384,529 B2 * 7/2022 Johnson ..... B65D 90/143
11,391,036 B2 * 7/2022 Crozier ..... E04B 1/343
2004/0006945 A1 * 1/2004 Price ..... E04B 2/06 52/169.12
2005/0028457 A1 * 2/2005 Davis ..... E02D 27/01 52/169.12
2009/0217600 A1 * 9/2009 De Azambuja ..... E04B 1/3444 52/79.5
2009/0266006 A1 * 10/2009 Gyory ..... E04B 1/3444 52/79.5
2010/0011676 A1 * 1/2010 Barry ..... E04B 1/3444 52/79.5
2010/0024315 A1 2/2010 Pope
2010/0024316 A1 2/2010 Pope
2010/0064599 A1 * 3/2010 Yang ..... E04B 1/3444 52/79.5
2010/0162636 A1 7/2010 Bonebrake
2010/0269419 A1 * 10/2010 Gyory ..... E04B 1/3483 52/79.5
2011/0252719 A1 * 10/2011 Wallance ..... E04H 1/04 52/79.5
2012/0006369 A1 1/2012 Cantin et al.
2012/0037198 A1 2/2012 Cantin et al.
2012/0151851 A1 * 6/2012 Cantin ..... E04B 1/34384 52/79.5
2012/0279142 A1 * 11/2012 Michaud ..... E04B 1/3442 52/79.5
2013/0263527 A1 10/2013 Barrett et al.
2014/0047778 A1 * 2/2014 DiGregory ..... E04B 1/19 52/79.5
2014/0144088 A1 * 5/2014 Heger ..... E04B 1/34384 52/79.5
2014/0150352 A1 * 6/2014 Lee ..... E04B 1/3444 52/79.5
2014/0157685 A1 * 6/2014 Fagan ..... E04H 1/12 52/79.5
2014/0311051 A1 * 10/2014 Fagan ..... E04B 1/343 52/79.5
2015/0267396 A1 9/2015 Cantin et al.
2015/0315776 A1 11/2015 Duncan
2016/0040443 A1 * 2/2016 Stephenson ..... E04H 1/005 52/79.5
2016/0069062 A1 * 3/2016 Dynon ..... E04B 1/343 52/79.5
2017/0081867 A1 3/2017 Wasson
2017/0350114 A1 12/2017 Crozier
2020/0224406 A1 7/2020 Brezan et al.
2020/0256050 A1 8/2020 Crozier
2020/0392722 A1 12/2020 Chinn
2021/0180314 A1 6/2021 Banerjee et al.
2021/0188532 A1 6/2021 Trout et al.
2023/0015863 A1 * 1/2023 Lontz ..... H05K 9/0081

FOREIGN PATENT DOCUMENTS

AU 2017101610 A4 12/2017
AU 2018100606 B4 6/2018
AU 2015255643 B2 10/2019
AU 2020100795 A4 6/2020
AU 2020100795 B4 6/2020
AU 2020101688 A4 9/2020
AU 2021101334 A4 5/2021
BR PI10921923 B1 12/2015
CA 2742778 A1 5/2010
CA 2968739 C 12/2017
CA 3035354 C 3/2018
CN 202125088 U 1/2012
CN 102995929 A 3/2013
CN 202970004 U 6/2013
CN 203499011 U 3/2014
CN 205296399 U 6/2016
CN 107074441 A1 8/2017
CN 108448396 A 6/2018
CN 109312561 B 2/2019
CN 110847637 B 2/2020
CN 213083004 U 4/2021
EP 0489673 B1 6/1996
EP 2217512 B2 8/2010
EP 2376351 B1 10/2011
EP 3003913 B1 7/2019
ES 2378247 T3 9/2006
ES 2761925 9/2019
GB 2460952 A 12/2009
HU 230312 B1 12/2015
JP H0719529 U 4/1995
JP 6475886 B1 6/2002

(56) References Cited

FOREIGN PATENT DOCUMENTS

| | | | |
|---|---|---|---|
| JP | 3318090 | B2 | 8/2002 |
| JP | 3350221 | B2 | 11/2002 |
| JP | 3455104 | B2 | 10/2003 |
| JP | 5481384 | B2 | 4/2014 |
| JP | 5564138 | B1 | 7/2014 |
| JP | 6792535 | B2 | 11/2020 |
| KR | 100714159 | B1 | 5/2007 |
| KR | 100928451 | B1 | 11/2009 |
| KR | 100934394 | B1 | 12/2009 |
| KR | 101152971 | B1 | 6/2012 |
| KR | 101800585 | B1 | 11/2017 |
| KR | 101996502 | B1 | 7/2019 |
| WO | 2013/173430 | A1 | 11/2013 |
| WO | 2013/173902 | A1 | 11/2013 |
| WO | 2014/037689 | A1 | 3/2014 |
| WO | 2014/142384 | A1 | 9/2014 |
| WO | 2016046531 | A1 | 3/2016 |
| WO | 2016/142563 | A1 | 9/2016 |
| WO | 2017/134126 | A1 | 8/2017 |

OTHER PUBLICATIONS

YouTube Video screenshots; MDSC Systems Ltd; Special Purpose Containers; Jul. 16, 2021.

Berg; An HDT Global Company; 3-in-1 TriCon Expandable Shelter System; Website; Jul. 16, 2021.

Seabox; Tricon 2-Side Expandable Container; Website; Jul. 16, 2021.

* cited by examiner

EXPANDABLE PORTABLE SHELTER AND STRUCTURES OF MULTIPLE EXPANDABLE PORTABLE SHELTERS

FIELD

Methods for and systems for portable shelters, and more particularly methods and systems for expandable portable shelters.

BACKGROUND

Expandable portable shelters (EPSs) which can be transported through standard intermodal shipping channels are useful for military or civilian projects of short duration or projects which are sufficiently remote that on-site construction is uneconomical. EPSs have a collapsed state with dimensions suitable for storage and transport, and an expanded state to provide an enclosed area for human activity and/or equipment storage that is greater than the enclosed area of the collapsed state. To facilitate transport in standard shipping channels, collapsed EPSs have dimensions of conventional intermodal shipping containers.

EPSs are made according many different construction schemes and are therefore suitable for different purposes as well as for use in different environments. For example, a shelter having foldable/flexible walls (e.g., made of canvas) may be suitable in some instances, whereas rigid walls (also referred to herein as rigid panels) may be required in other instances. For example, rigid walls may be of composite construction including multiple plies of sheet metal with insulation disposed between the plies.

In many instances, it is desirable that an EPS, in a collapsed state, has dimensions equal to an ISO intermodal shipping container for shipment in standard intermodal shipping channels; however, in other instances, the EPS in a collapsed-state has a dimension (e.g., a length or width) that is a unit-fractional amount of a conventional shipping container, such that multiple EPSs placed side-by-side and connected together achieve dimensions equal to an ISO intermodal shipping container.

EPSs that, in a collapsed state, are a unit-fractional amount of a conventional shipping container that is 20-feet length are known to be provided in BICON, TRICON and QUADCON configurations. The designation BICON refers to an EPS that has a depth of half the length of a 20-foot ISO intermodal shipping container (i.e., a depth of 10 feet); the designation TRICON refers to a EPS that has a depth of one-third the length of a 20-foot ISO intermodal shipping container (i.e., a length of 6.6 feet); and the designation QUADCON refers to a EPS that has a depth of one-quarter the length of a 20-foot intermodal shipping container (i.e., a length of 5 feet). A structure comprising multiple, collapsed EPSs placed side-by-side to achieve dimensions equal to an ISO intermodal shipping container is referred to herein as a multicon structure.

A further goal of an EPS or an multicon structure is that, when it is in an expanded state, it achieves an enclosed area for human activity that is greater than the EPS or multicon structure footprint in the collapsed state. Accordingly, a goal for a single EPS having dimensions equal to an ISO intermodal shipping container or for BICON, TRICON and QUADCON multicon structures is that, when expanded, the single EPS or the multiple EPSs forming the multicon structure provide an enclosed area for human activity that is substantially greater than the ISO container footprint.

FIG. 1A is a schematic illustration of a conventional EPS 100 in a collapsed state having dimensions of a conventional intermodal shipping container. In the collapsed state, panel 110*a* and panel 110*a*' (shown in FIG. 1B) are folded down to form sides of the EPS. FIG. 1B is a schematic illustration of the EPS 100 of FIG. 1A in an expanded state, in which panels 110*a* and 110*a*' are folded up to form a ceiling over an area for human activity. Expanded EPSes may be used individually (i.e., separated from one another) or may be connected together to provide a single, connected area for human activity. As is apparent from FIG. 1B, when the EPS is expanded, the enclosed area for human activity can be increased to about three-times the footprint of the collapsed container. While BICON, TRICON and QUADCON EPSs are known, conventional BICON, TRICON and QUADCON EPSs do not increase the enclosed area available for human activity. In FIGS. 1A and 1B, the dashed lines show, schematically, the outlines of conventional TRICON EPSs (having a depth d equal to one-third of the length l of the multicon structure) from which it is apparent that the enclosed area available for human activity is not increased beyond the three-time increase over the collapsed state provided by single container having dimension of a conventional intermodal shipping container and, in fact, decrease the enclosed area available for human activity due to the need for additional support structure at the corners of each EPS of the multicon structure.

What is needed is an EPS multicon structure with a relatively-high ratio of area for human activity when in an expanded state to area of the collapsed multicon structure footprint.

SUMMARY

The inventor has determined that, by having the walls of the collapsed structure fold out from faces disposed transverse (substantially perpendicular) to the length dimension of the multicon structure and by dividing the length of an ISO container into a greater than conventional number of expandable EPSs (i.e., more than four EPSs), a relatively high ratio of area for human activity and/or equipment storage when in an expanded state to the area of the collapsed multicon structure footprint can be achieved. Additionally, as a result of the above configuration, the walls (made of conventional materials, such as steel) can be the sized such that a single person can collapse or expand the EPSs. Additional aspects of the invention are directed to corner post assembly designs suitable to reduce the area needed for support structure, thereby increasing the area available for panels and the corresponding area for human activity and/or equipment within the expanded structure. Although the invention is described in terms of increasing area for human activity and/or equipment storage, the invention could similarly be characterized, in three dimensions, as increasing space for human activity or equipment storage.

An aspect of the present invention is directed to a multicon structure characterized by a structure length, structure width and structure height. The structure comprises six or twelve expandable portable shelters (EPSs). The EPSs are characterized by equal depth dimensions extending in the direction of the structure length and each EPS has two faces that are transverse to the structure length. Each EPS comprises two sets of panels, each set of panels comprising a floor panel, a ceiling panel, side panels, and an end panel. For each EPS, each set of panels folding out from a corresponding one of the faces. For example, in instances of a 20-foot long multicon structure, six EPSs allow for an increased number of EPSs beyond conventional multicon structures, which results in a corresponding increase in the number of sets of panels present in the multicon structure thus providing for increased area for human activity and/or equipment storage when the EPSs are in an expanded state, while allowing pairs of collapsed EPSs to be handled in manner similar to a conventional TRICON EPS, and while leaving sufficient room within the collapsed structure for storage of equipment. In instances of a 40-foot long multicon structure, twelve EPSs allow for similar functionality.

In some embodiments, the faces have a same face width and a same face height as one another, and each panel has a width substantially equal to the face width and a height substantially equal to the face height.

In some embodiments, the floor panels or the ceiling panels are outer panels of each of the EPSs. In some embodiments, each EPS comprises a frame and the outer panels form a watertight seal with the frame.

In some embodiments, each EPS comprises a frame having a frame top and a frame bottom, and each floor panel is rotatably coupled to the frame bottom, and each ceiling panel is rotatably coupled to the frame top. In some embodiments, the frame comprises corner posts extending between the frame top and the frame bottom, and each of the side panels is rotatably coupled to one of the corner posts.

The structure length may equal about 20 feet or about 40 feet. The structure width may equal about 8.0 feet and the structure height may equal about 8.0 feet, 8.5 feet or 9.5 feet.

In some embodiments, each EPS has an expanded state, in which an enclosed area for human activity or equipment storage is defined in-part by the EPS's two sets of panels.

Another aspect of the invention is directed to an expandable portable shelter (EPS) characterized by a depth that is a unit fractional amount of an intermodal shipping container length. The EPS has two faces that are transverse to the depth, the EPS comprising two sets of panels, each set of panels comprising a floor panel, a ceiling panel, side panels, and an end panel. Each set of panels folds out from a corresponding one of the two faces.

In some embodiments, the faces have a same face width and a same face height as one another, and each panel has a width substantially equal to the face width and a height substantially equal to the face height.

In some embodiments, the floor panels or the ceiling panels are outer panels of the EPSs. In some embodiments, the EPS comprises a frame and the outer panels form a watertight seal with the frame.

In some embodiments, the EPS comprises a frame having a frame top and a frame bottom, wherein the floor panel is rotatably coupled to the frame bottom, and the ceiling panel is rotatably coupled to the frame top.

In some embodiments, the frame comprises corner posts extending between the frame top and the frame bottom, and each of the side panels is rotatably coupled to one of the corner posts.

For example, the depth may equal about 3.3 feet. In some embodiments, the EPS has a width of about 8.0 feet and a height of about 8.0 feet, 8.5 feet or 9.5 feet.

Another aspect of the invention is directed to expandable portable shelter (EPS) characterized by a depth, a width and a height, the EPS having (I.) a collapsed state in which two outer rigid panels, a plurality of inner rigid panels and two doors are supported by a frame such that the outer rigid panels and two doors define a four-sided perimeter, the two outer rigid panels are rotatably coupled to the frame and form a first set of opposing sides of the perimeter and the doors form a second set of opposing sides of the perimeter, and (II.) an expanded state to provide area for human activity and/or equipment storage defined in-part by the outer rigid panels and the inner rigid panels. The frame comprises four vertical, corner post assemblies. Each of the four corner post assemblies is connected to a frame top by a corresponding corner casting, and each of the four corner post assemblies is connected to a frame bottom by a corresponding corner casting. In a plane transverse to the height of the EPS, each of the corner post assemblies comprises: (A.) a tubular stiffening structure; (B.) a hinge mount feature which, when the EPS is in the collapsed state, has a first segment that extends from the tubular stiffening structure in a direction transverse a plane defined by an outer surface of one of the doors and a second segment that extends in a direction parallel to the plane defined by the outer surface of one of the doors; and (C.) a panel interface feature which, when the EPS is in the collapsed state, has a first segment that extends from the tubular stiffening structure in a direction parallel to a plane defined by an outer surface of one of the outer rigid panels and a second segment forming a vertex with the first segment, the second segment extending transverse to the plane defined by the outer surface of the one of the outer rigid panels. The second segment of the panel interface feature having an interface surface defining, in-part, an opening in which the one of the outer rigid panels is disposed. The one of the outer rigid panels having a gasket attached thereto positioned such that, when the one of the outer rigid panels is in the collapsed state, a watertight seal is formed between the gasket and the interface surface.

In some embodiments, the tubular stiffening structure has a closed shape in the plane.

In some embodiments, the first segment of the hinge mount extends from the tubular stiffening structure in a direction perpendicular to the plane defined by an outer surface of one of the doors.

In some embodiments, the first segment of the hinge mount and the second segment of the hinge mount extend perpendicular to one another. The hinge mount may have an L-shape in the plane. In some embodiments, the first segment of the hinge mount and the second segment of the hinge mount are joined together by a curved portion.

In some embodiments, the second segment of the panel interface feature extends from the tubular stiffening structure in a direction perpendicular to the plane defined by an outer surface of the rigid panel.

The first segment of the panel interface feature and the second segment of the panel interface feature may extend perpendicular to one another. In some embodiments, the panel interface feature has an L-shape in the plane; and in some embodiments, the first segment of the panel interface feature and the second segment of the panel interface feature are joined by a curved portion.

The watertight seal may extend from a corner casting at the frame top to one of the corner castings at the frame bottom.

In some embodiments, the second segment of the door interface feature has an incurvation located more distally to the vertex than the interface surface, the incurvation forming a concave surface facing toward the opening. One of the inner rigid panels may be coupled to the door interface feature by a hinge located in the incurvation.

In some embodiments, the hinge mount feature, the panel interface feature and at least a portion of the tubular stiffening structure are formed of a single piece of material.

These and other aspects of the present invention will become apparent upon a review of the following detailed description and the claims appended thereto.

As used herein the term "intermodal shipping container" (also referred to herein as an "intermodal container") refers to a container having ISO 1C or 1CC or 1CCC or 1A or 1AA or 1AAA outer dimensions (i.e., about 8.0 feet in width, and about 8.0, 8.5 or 9.5 feet in height, and about 20 or 40 feet in length).

The term "rigid" as used herein refers to an object that is able to support itself against gravity in all orientations. It will be appreciated that a rigid object may some flexibility. A portion of an object that cannot support itself against gravity (e.g., an excessively thinned portion) is not rigid.

The term "unit fraction" is defined herein to be an amount equal to 1/n, where n is an integer; and a "unit fractional amount" of a portion M equals 1/n*M, where M is a fixed amount.

DETAILED DESCRIPTION

The invention will be further illustrated with reference to the following specific examples. It is understood that these examples are given by way of illustration and are not meant to limit inventions beyond language set forth in the claims.

Figure 1A:
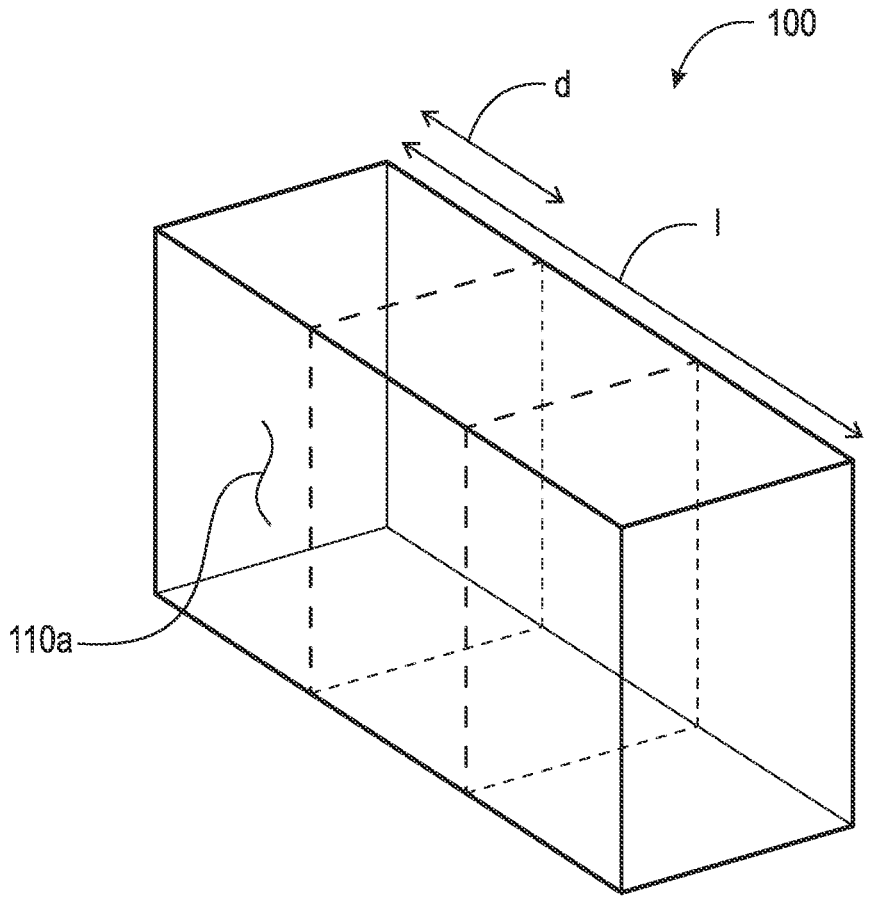
(PRIOR ART) Fig. 1A
FIG. 1A is a schematic illustration of a conventional EPS in a collapsed state having dimension of a conventional intermodal shipping container.
Figure 1B:
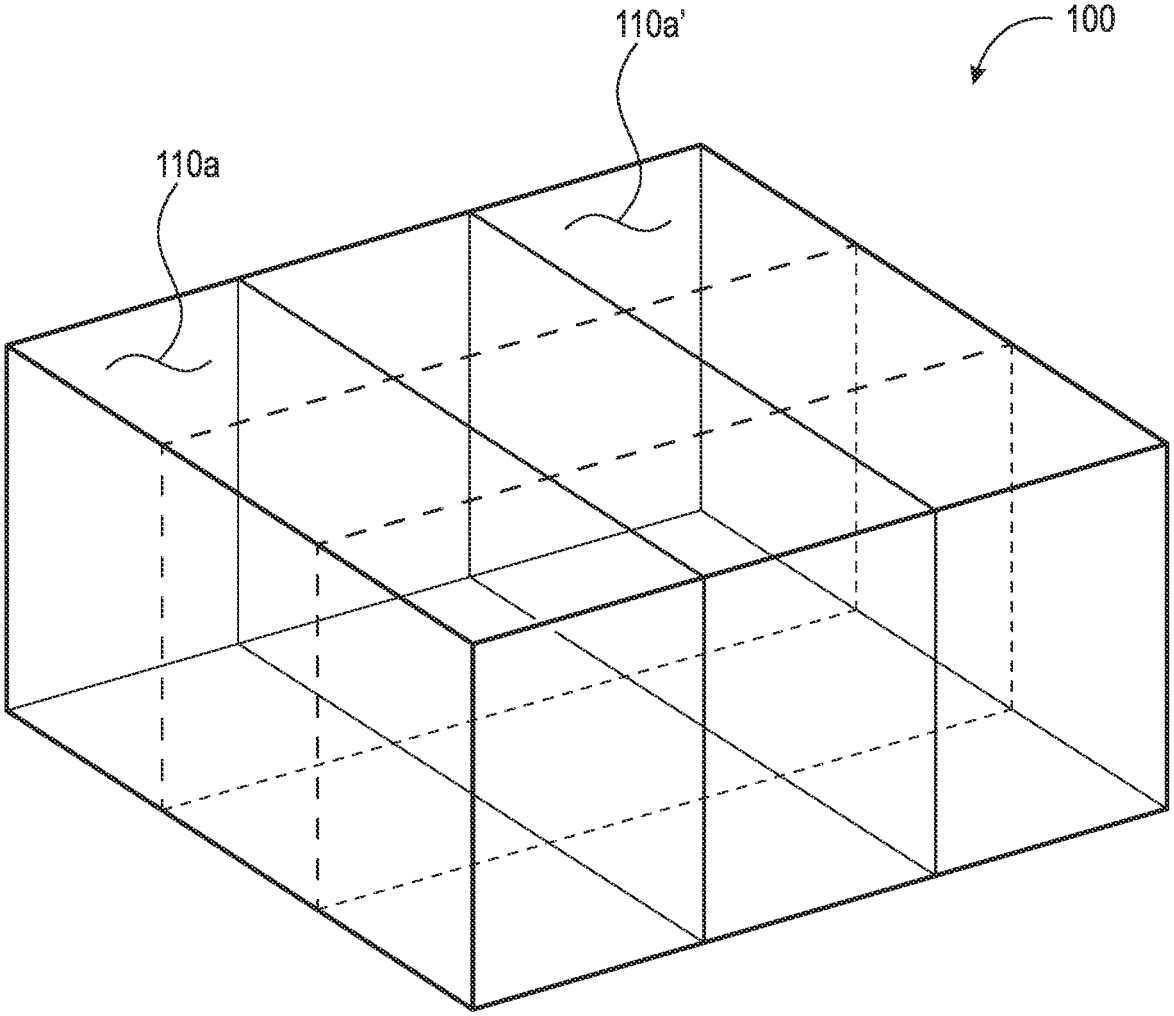
(PRIOR ART) Fig. 1B
FIG. 1B is a schematic illustration of the EPS of FIG. 1A in an expanded state.
Figure 2A:
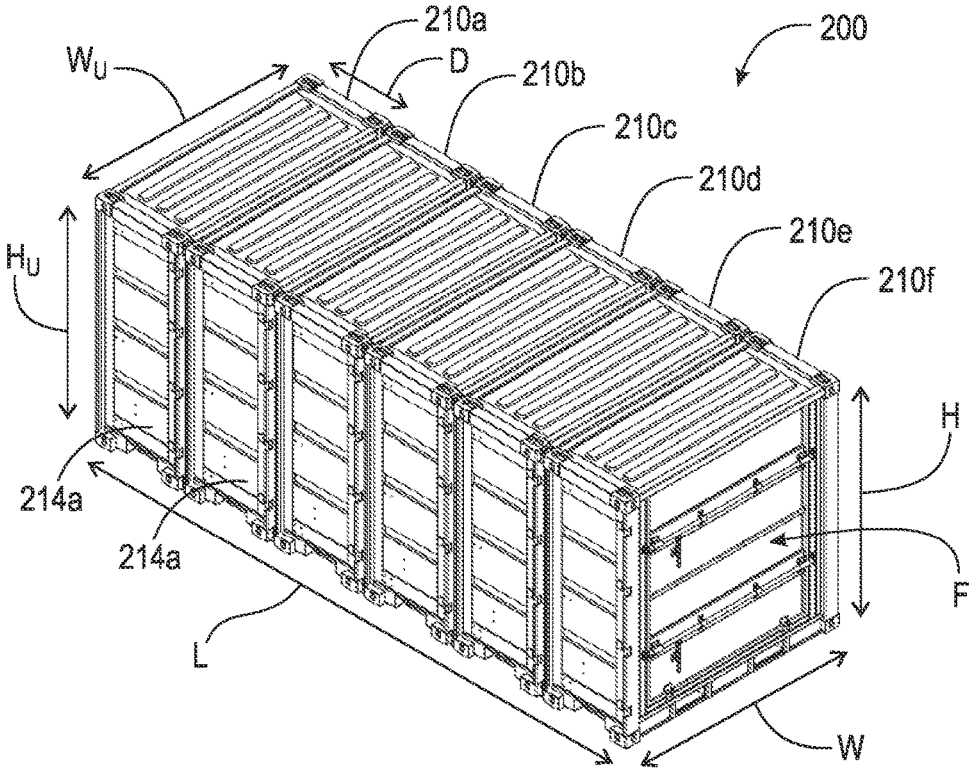
FIG. 2A is a schematic, perspective view of an example of a multicon structure according to aspects of the present invention, in a collapsed state.
Figure 2B:
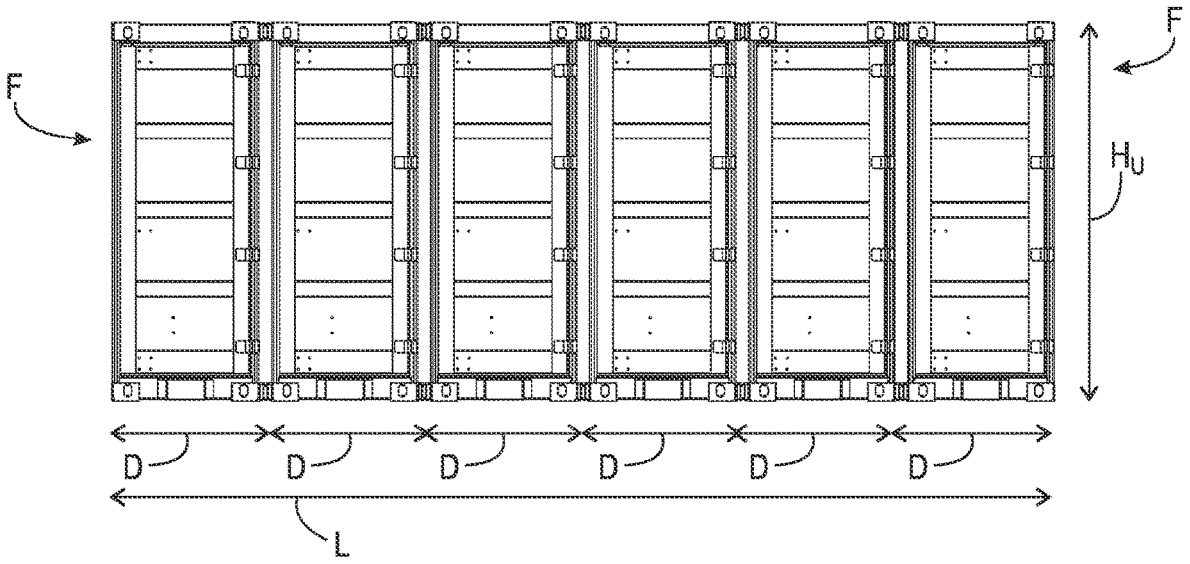
FIG. 2B is a schematic, first side view of the collapsed multicon structure of FIG. 2A.
Figure 2C:
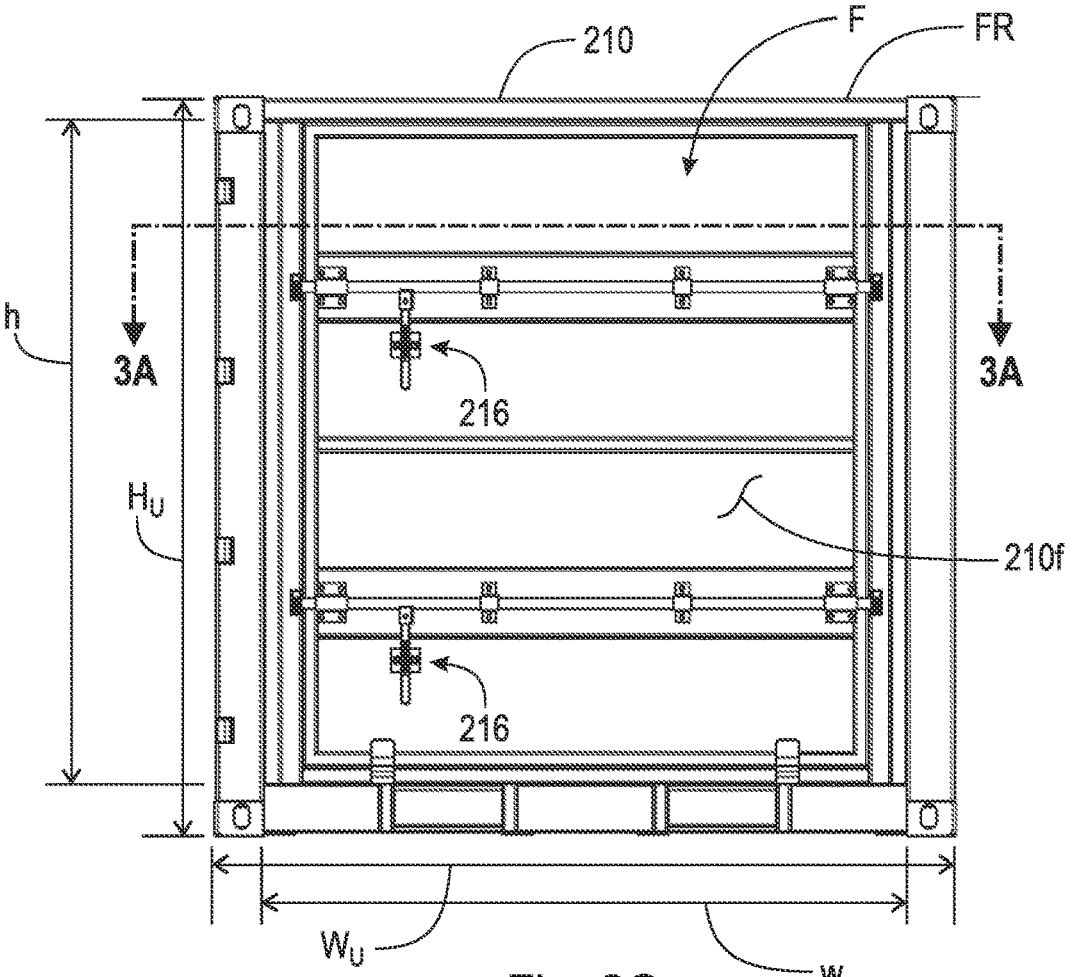
FIG. 2C is a schematic, second side view of the collapsed multicon structure of FIG. 2A.

FIGS. 2A-2C are schematic illustrations of an example of a multicon structure 200 according to aspects of the present invention, in a collapsed state. Multicon structure 200 is characterized by a structure length L, structure width W, and structure height H. Structure 200 comprises six expandable portable shelters (EPSs) 210*a*-210*f*. In the illustrated embodiment, structure length L is about 20 feet (i.e., a length as specified by ISO 1C or 1CC or 1CCC). As described below, EPSs 210*a*-210*f* allow for increased ratio of enclosed area for human activity and/or storage of equipment when the EPSs are in an expanded state to the area of the collapsed multicon structure footprint, as compared to conventional EPSs.

Each EPS 210 is characterized by a depth D extending in the direction of the structure length L. Typically, all of the EPSs have the same depth D. In the illustrated embodiment, each EPS has a depth of about 3.3 feet. It will be appreciated that dividing a multicon structure (20-feet in length) into a greater number of EPSs may be precluded by a need for allowing adequate enclosed area for electrical and mechanical appliances E (shown in FIG. 4) when the EPSs are in the collapsed state. Advantageously, a single EPS is relatively small compared to conventional EPS thereby allowing for one person to collapse and expand the EPS, and two EPSs placed side-by-side have a depth equal to a conventional TRICON EPS allowing for handling similar to a conventional TRICON EPS.

While the illustrated example shows a 20-foot structure divided into 6 EPSs, a structure may have a structure length L of about 40 feet (i.e., a length as specified by ISO 1A or 1AA or 1AAA), with the structure comprising twelve EPSs. Similar to the illustrated embodiment, in such a configuration, each EPS has a depth of about 3.3 feet; and such a construction results in a ratio of enclosed area for human activity and/or storage of equipment when the EPSs are in an expanded state to the area of the collapsed multicon structure footprint that is the same as for the 6-EPS structure.

Each EPS 210 has a width $W_U$ and a height $H_U$ corresponding to (and equal to) structure width W and structure height H, and two faces that are transverse (and in the illustrated embodiment perpendicular) to structure length L, although only a single face F is shown (i.e., the face of EPS 210*f*). Each face is defined by an EPS side exclusive of the frame (i.e., the opening outlined by the frame). Each face is characterized by a face height h and face width w. Face height h and face width w are reduced from the structure height H and structure width W due to the shape and dimension of components of frame FR. An example of corner post construction of frame FR is discussed in greater detail, below, with reference to FIGS. 4A, 5A and 5B.

Figure 3A:
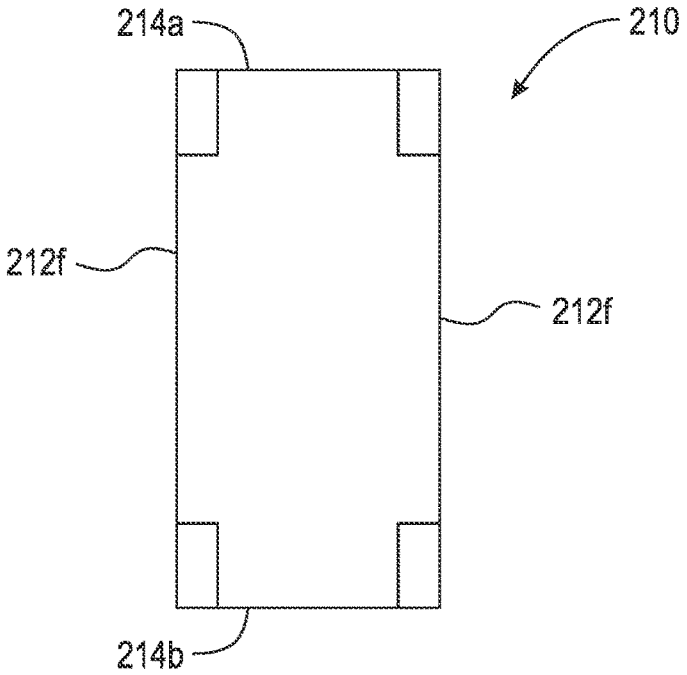
FIG. 3A is a schematic cross-sectional view of an example of an EPS (i.e., a representative EPS from the multicon structure shown in FIGS. 2A-2C) according to aspects of the present invention, in a collapsed state, with a cross-section taken along line 3A-3A in FIG. 2C.

In the collapsed state, as shown in FIG. 3A for a representative one of EPSs 210*a*-210*f*, two outer rigid panels (floor panels 212*f*) and two doors 214*a*, 214*b* define a four-sided perimeter. As illustrated in FIGS. 2A-2C, the outer surfaces of the doors may be contoured but they define identifiable planar surfaces. The outer rigid panels form the faces of EPS 210 with the edges of the outer panels forming watertight seals with the frame, as is discussed in greater detail below.

Figure 3B:
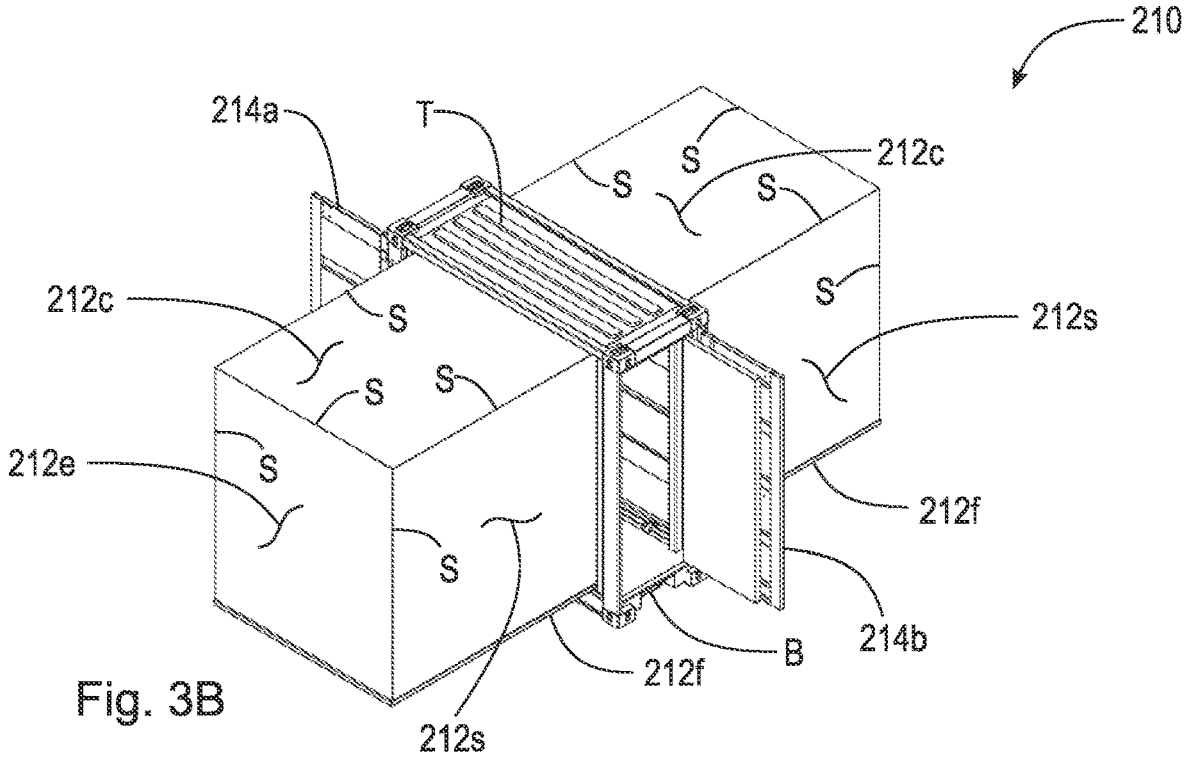
FIG. 3B is a schematic, projection view of the EPS of FIG. 3A, in an expanded state.

In the collapsed state, each of the two outer rigid panels covers a plurality of inner rigid panels (the inner panels are visible in FIG. 3B). In the collapsed state, the two outer rigid panels, the plurality of inner rigid panels and the two doors 214*a*, 214*b* are supported by frame FR. In the collapsed state, the two outer rigid panels form a first set of opposing sides of the perimeter which are rotatably coupled to frame FR. The doors form a second set of opposing sides of the perimeter. For example, the outer panels may be latched to the frame using a cam lock 216 or other suitable latching mechanism thereby maintaining the outer panels as well as the inner rigid panels in the collapsed state.

FIG. 3B is a schematic illustration of representative EPS 210 according to aspects of the present invention, in an expanded state. As set forth above, each EPS 210 has two sets of panels 212. As is visible in FIG. 3B, each set of panels 212 folds out from a corresponding one of faces F. Each set of panels 212 includes a floor panel $\mathbf{212}_f$ (shown more completely in FIG. 4), a ceiling panel $\mathbf{212}_c$, multiple side panels $\mathbf{212}_s$, and an end panel $\mathbf{212}_e$. In the illustrated embodiment, the sets of panels at each face F are the same.

In the illustrated embodiment, the floor panel constitutes an outer panel (shown for example in FIG. 2C), and the ceiling panel 212$_c$, side panels 212$_s$, and an end panel 212$_e$ constitute a set of inner panels Although in the illustrated embodiment, the two outer rigid panels are floor panels, in other embodiments, the outer rigid panels may be ceiling panels or side panels.

In the expanded state, EPS 210 provides interior area for human activity and/or storage of equipment that is defined in-part (and predominantly) by the outer panels and the inner rigid panels; however, a relatively small portion of the enclosed area is defined by the top, bottom and sides of the original collapsed structure.

In the illustrated embodiment, the outer panel (i.e., the floor panel 212*f*) is rotatably coupled to the frame bottom B of frame FR (shown in FIG. 4); the ceiling panel 212*c* is rotatably coupled to the frame top T of frame FR; each side panel 212*s* is rotatably coupled to a corresponding corner post assembly 220*a*-220*d* (shown in FIG. 4); and the end panel 212*e* is rotatably coupled to one of side panels 212*s* (e.g., by one or more hinges (not shown)). After the panels are rotated to achieve the expanded state, seams S are present between adjacent panels 212 and latches (not shown) are used to couple adjacent panels at the seams, to form a fixed, closed structure. The order in which the panels 212 are stacked and are stored in the collapsed state is not essential; however, ceiling panel 212*c* and floor panel 212*f* will be attached to frame FR using a hinge having a horizontal axis of rotation, and side panels will be attached to the frame using a hinge having a vertical axis of rotation. End panel 212*e* can be coupled to a side edge of any of the ceiling, floor and side panels by hinge or simply attached to said panels by one or more latches.

In some embodiments, each panel has panel side-dimensions approximately equal to the face width w and face height h of the faces (shown in FIG. 2C). It is to be appreciated that it typically desirable that panel side dimensions are large as possible; however, some clearance is needed relative to the frame to allow the panels to be rotated into positions to form an expanded state. The face height and face width are less than the structure height and the structure width by an amount determined by construction of corner post assemblies 220*a*-220*d*, and the frame top and the frame bottom of frame FR.

In some embodiments, the rigid outer panels may be made of steel, aluminum or a composite materiel to provide protection to the entire structure when collapsed (such as during transport). The rigid inner panels are typically made of lighter construction such as multiply construction of sheet metal and insulation, with the insulation disposed between the sheet metal plies.

Figure 4:
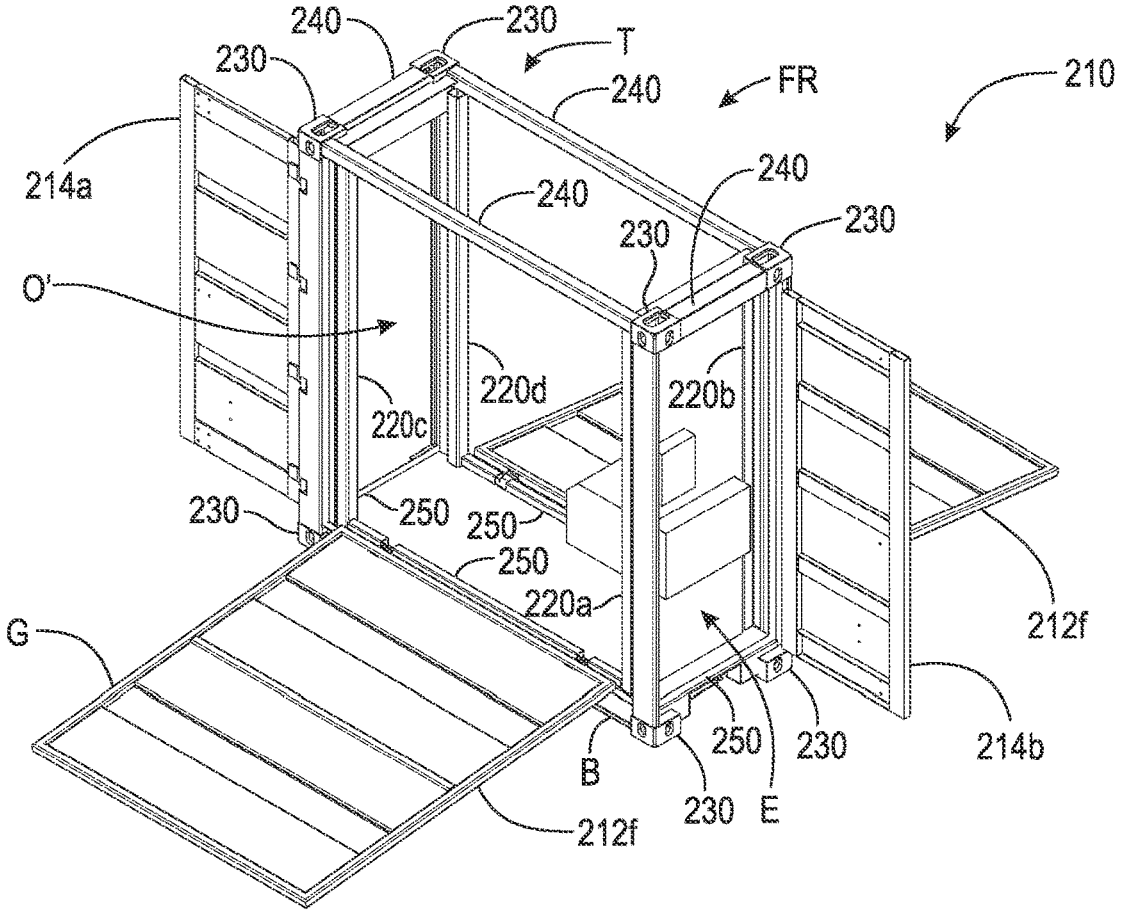
FIG. 4 is a schematic illustration of a portion of the EPS of FIG. 3B with the outer panels and doors opened, and with inner portions of the EPS and the ceiling panel omitted to more clearly show the frame.

FIG. 4 is a schematic illustration of a portion of the EPS of FIGS. 3A and 3B with the outer panels (floor panel 212*f*) and doors 214*a*, 214*b* opened, and with inner portions of the EPS (e.g., panels 212*c*, 212*e* and 212*s*) and the top of the original structure omitted, to more clearly show frame FR. The frame comprises four corner post assemblies 220*a*-220*d* (an embodiment of which is described in greater detail below with reference to FIGS. 5A and 5B), eight corner castings 230 (only seven are visible), four top posts 240 (forming a frame top T), and four bottom posts 250 (forming a frame bottom B). In the illustrated embodiment, door 214*a* provides access to the interior of a collapsed and expanded structure, and door 214*b* provides access to electrical and mechanical equipment E.

Figures 5A, 5B:
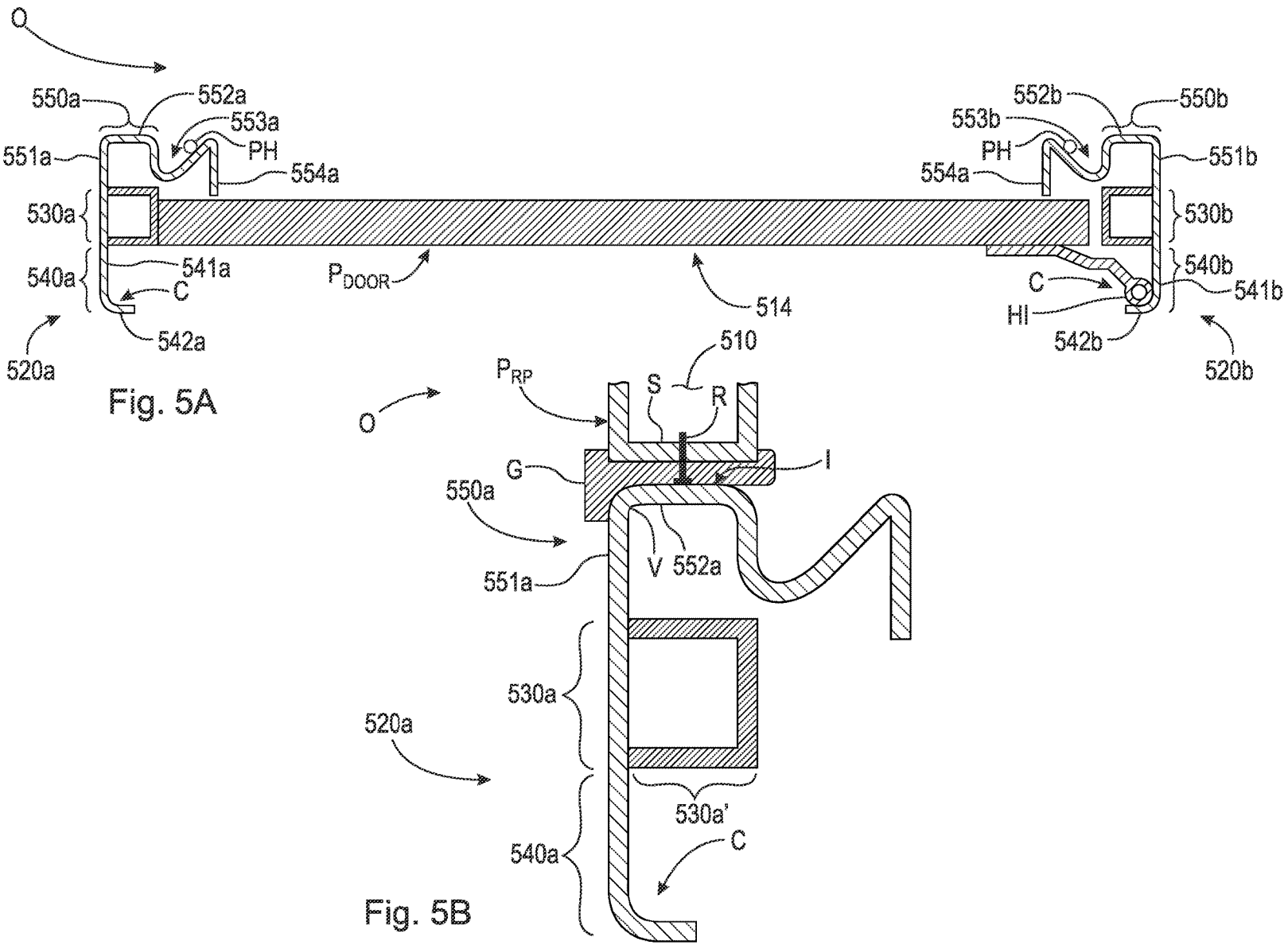
FIG. 5A is a cross-sectional view of one side of a EPS including a door (the door in a closed position) and illustrating corner post assemblies according to aspects of the present invention.
FIG. 5B is a cross-sectional view of one corner post assembly of FIG. 5A in greater detail.

FIG. 5A is a partial cross-sectional view of one side of an EPS (such as EPS 210), including a door 514. The view shows corner post assemblies 520*a*, 520*b* according to aspects of the present invention which may be used, for example, to form corner post assemblies 220*a*-220*d* in EPS 210 shown in FIG. 4. FIG. 5B shows post assembly 520*a* in greater detail. The illustrated corner post assemblies efficiently use space needed for panel and door support structure, thereby increasing the space available for panels and the corresponding area for human activity and/or equipment within the expanded structure.

The cross-section shown in FIG. 5A is taken in a plane transverse to the height of the EPS (e.g., height $H_u$). Corner post assemblies 520*a*, 520*b* are designed to facilitate operation of various panels and doors (e.g., panels 212 and doors 214*a*, 214*b* shown in FIGS. 2A-3B). In the plane of the cross-section, each corner post assembly 520*a*, 520*b* comprises a tubular stiffening structure 530*a*, 530*b*, and each of the corner post assemblies comprises a door hinge mount feature 540*a*, 540*b* and a panel interface feature 550*a*, 550*b*. In some embodiments, in the plane of the cross-section, the tubular structure forms a closed shape, although the tubular structure may provide the desired stiffening and be less than closed. The closed shape may be square (as illustrated), rectangular, round, oval or any shape providing suitable stiffness.

Each hinge mount feature 540*a*, 540*b*, when the EPS is in the collapsed state, has a first segment 541*a*, 541*b* that extends from a corresponding tubular stiffening structure 530*a*, 530*b* in a direction transverse to a plane $P_{door}$ defined by an outer surface of door 514 and a second segment 542*a*, 542*b* that extends in a direction parallel to plane $P_{door}$. In some embodiments, the first segment 541*a*, 541*b* may be perpendicular to plane $P_{door}$. In some embodiments the first segments 541*a*, 541*b* and second segments 542*a*, 542*b* of the hinge mount feature 540*a*, 540*b* may extend perpendicular to one another; however, in other embodiments, the segments are other than perpendicular and may be joined by a curved portion (as shown). To extend in a direction parallel to plane $P_{door}$, second segment 542*a*, 542*b* need not be straight and extend only in a direction parallel; rather, it predominantly extends in such direction and may include some curvature.

Each panel interface feature 550*a*, 550*b*, when the EPS is in the collapsed state, has a first segment 551*a*, 551*b* that extends from a corresponding tubular stiffening structure 530*a*, 530*b* in a direction parallel to a plane $P_{RP}$ defined by an outer surface of one of the outer rigid panels 510 and a second segment 552*a*, 552*b* forming a vertex V with the first segment 551*a*, 551*b* that is transverse to the plane $P_{RP}$ defined by outer surface of the one of the outer rigid panels 510. Second segment 552*a*, 552*b* has an interface surface I. Interface surface I defines, in-part, an opening O in which the one of the outer rigid panels 510 is disposed. (A corresponding opening O' is shown in FIG. 4 for outer rigid panel (i.e., floor panel 212*f*)). In some embodiments, as shown in FIGS. 5A and 5B, in the plane of the cross-section, a hinge mount feature (e.g., hinge mount feature 540*a*), a panel interface feature (e.g., panel interface feature 550*a*) and at least a portion of a tubular stiffening structure 530*a* are formed of a single piece of material (i.e., of unitary construction) and a remainder of the stiffening structure 530*a*' is attached to the single piece of material. For example, the remainder of the stiffening structure is welded to the single piece of material.

As shown in FIG. 4, a gasket G is disposed around a perimeter of floor panel 212*f*. For example, the gasket can be attached by a series of rivets R (a representative rivet is shown in FIG. 4) or adhesive or other suitable technique.

Gasket G interfaces with surface I of panel interface feature 550*a* such that, when the outer rigid panel (i.e., floor panel 212*f*)) is in a closed position, a watertight seal is formed between the corner post assembly 520*a* and outer rigid panel 510. For example, gasket G may be made of butyl rubber or other suitable material. In some embodiments, the second segment 552*a*, 552*b* may be perpendicular to plane $P_{RP}$. In some embodiments the first segments 551*a*, 551*b* and second segments 552*a*, 552*b* of panel interface feature 550*a*, 550*b* may be perpendicular to one another; however, in other embodiments, the segments are other than perpendicular and may be joined by a curved portion (as shown). To extend in a direction parallel to plane $P_{RP}$, first segment 551*a*, 551*b* need not be straight and need not extend only in a direction parallel to plane $P_{RP}$; rather, it predominantly extends in such direction and may include some curvature; however, the second segment is large enough and flat enough to allow application of a gasketing material thereon to form a watertight seal with panel 510 over multiple uses.

Typically, a rigid outer panel (floor panel 212*f*) and panel interface features 550*a*, 550*b* extend such that the watertight seal extends along the entire height h of the outer rigid panel, and from a corner casting at the frame top to a corner casting at the frame bottom.

In some embodiments, first segment 541*a* and the second segment 542*a* of hinge mount feature 540*a* constitute a first L-shaped feature; and the first segment 551*a* and the second segment 552*a* of panel interface feature 550*a* constitute a second L-shaped feature; however, the segments may be straight or may include some curvature. Vertex V may be ninety degrees or about ninety degrees or may include a curvature; however, a concavity C is present to maintain a hinge HI therein for coupling to a door.

In the illustrated embodiment, second segments 552*a*, 552*b* of panel interface features 550*a*, 550*b* have an incurvation 553*a*, 553*b* located more distal to vertex V than the interface surface I, within which one or more panel hinges PH (e.g., for a side panel 212*s*) is attached. (The incurvation forms a concave surface facing toward opening O.) The axis of panel hinge PH extends vertically. Typically, the entire incurvation (and hinge) do not extend beyond the interface surface I into the opening O, to avoid a need to reduce the dimensions of panels (e.g., panels 212 shown in FIG. 3B). Also, typically no portion of a panel interface feature 550*a*, 550*b* extends beyond the interface surface I into the opening O.

In some embodiments, the tubular stiffening structures 530*a*, 530*b* extend from one of the corner castings 230 at the frame top to one of the corner castings 230 at the frame bottom (shown in FIG. 4). However, depending on the shape of the tubular stiffening structure and the material selected to form the corner post assembly, the tubular stiffening structures may extend less than from one of the corner castings 230 at the frame top to one of the corner castings 230 at the frame bottom.

As illustrated, in some embodiments, the panel interface features 550*a*, 550*b* further comprise a third segment 554*a*, 554*b* extending from the incurvation 553*a*, 553*b* in a direction transverse to the plane $P_{door}$ formed by the outer surface of door 514 thereby forming a stop to prevent the door from rotating toward the interior of the EPS.

Hinge mount features 540*a*, 540*b* may extend from a corner casting 230 at the frame top of the frame FR to a corner casting 230 at the bottom of the frame FR; however, the hinge mount features may only extend over portions of the length of the corner post assembly 520*a*, 520*b* where the hinges HI are present.

Although various embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A multicon structure characterized by a structure length, a structure width and a structure height, the structure length being longer than the structure width, the structure comprising:

six or twelve expandable portable shelters (EPSs) in a collapsed state, the EPSs having equal depth dimensions to one another, the depth dimensions extending in the direction of the structure length and each EPS having two faces that are transverse to the structure length, each EPS comprising two sets of rigid panels, each set of panels comprising a floor panel, a ceiling panel, side panels, and an end panel, for each EPS each set of panels folding out from a corresponding one of the faces.

2. The multicon structure of claim 1, wherein the faces have a same face width and a same face height as one another, and wherein each panel has a width substantially equal to the face width and a height substantially equal to the face height.

3. The multicon structure of claim 1, wherein the floor panels or the ceiling panels are outer panels of each of the EPSs.

4. The multicon structure of claim 3, wherein each EPS comprises a frame and the outer panels form a watertight seal with the frame.

5. The multicon structure of claim 3, wherein each EPS comprises a frame having a frame top and a frame bottom, wherein each floor panel is rotatably coupled to the frame bottom, and each ceiling panel is rotatably coupled to the frame top.

6. The multicon structure of claim 5, wherein the frame comprises corner posts extending between the frame top and the frame bottom and each of the side panels is rotatably coupled to one of the corner posts.

7. The multicon structure of claim 1, wherein the structure length equals about 20 feet and the structure comprises 6 EPSs or the structure length equals about 40 feet and the structure comprises 12 EPSs.

8. The multicon structure of claim 1, wherein the structure width is about 8 feet and the structure height equals about 8.0 feet, about 8.5 feet or about 9.5 feet.

9. The multicon structure of claim 1, wherein each EPS has an expanded state, in which an enclosed area for human activity or equipment storage is defined in-part by the EPS's two sets of panels.

10. An expandable portable shelter (EPS) characterized by a depth, a width and a height, the EPS having (I.) a collapsed state in which two outer rigid panels, a plurality of inner rigid panels and two doors are supported by a frame such that the outer rigid panels and two doors define a four-sided perimeter, the two outer rigid panels rotatably coupled to the frame and forming a first set of opposing sides of the perimeter and the doors forming a second set of opposing sides of the perimeter, and (II.) an expanded state to provide an enclosed area for human activity or equipment storage defined in-part by the outer rigid panels and the inner rigid panels, the frame comprising four vertical, corner post assemblies, each of the four corner post assemblies connected to a frame top of the frame by a corresponding corner casting, and each of the four corner post assemblies connected to a frame bottom of the frame by a corresponding corner casting, in a plane transverse to the height of the EPS, each of the corner post assemblies comprising (A.) a tubular stiffening structure, (B.) a hinge mount feature which, when the EPS is in the collapsed state, has a first segment that extends from the tubular stiffening structure in a direction transverse a plane defined by an outer surface of one of the doors and a second segment that extends in a direction parallel to the plane defined by the outer surface of one of the doors, and (C.) a panel interface feature which, when the EPS is in the collapsed state, has a first segment that extends from the tubular stiffening structure in a direction parallel to a plane defined by an outer surface of one of the outer rigid panels and a second segment forming a vertex with the first segment, the second segment extending transverse to the plane defined by the outer surface of the one of the outer rigid panels, the second segment of the panel interface feature having an interface surface defining, in-part, an opening in which the one of the outer rigid panels is disposed, the one of the outer rigid panels having a gasket attached thereto positioned such that, when the one of the outer rigid panels is in the collapsed state, a watertight seal is formed between the gasket and the interface surface.

11. The EPS of claim 10, wherein the tubular stiffening structure has a closed shape in the plane transverse to the height.

12. The EPS of claim 10, wherein the first segment of the hinge mount feature extends from the tubular stiffening structure in a direction perpendicular to the plane defined by the outer surface of one of the doors.

13. The EPS of claim 10, wherein the first segment of the hinge mount feature and the second segment of the hinge mount feature extend perpendicular to one another.

14. The EPS of claim 10, wherein the hinge mount feature has an L-shape in the plane.

15. The EPS of claim 14, wherein the first segment of the hinge mount feature and the second segment of the hinge mount feature are joined together by a curved portion.

16. The EPS of claim 10, wherein the second segment of the panel interface feature extends in a direction perpendicular to the plane defined by the outer surface of the outer rigid panel.

17. The EPS of claim 10, wherein the first segment of the panel interface feature and the second segment of the panel interface feature extend perpendicular to one another.

18. The EPS of claim 10, wherein the first segment and the second segment of the panel interface feature form an L-shape in the plane transverse to the height $H_u$.

19. The EPS of claim 10, wherein the first segment of the panel interface feature and the second segment of the panel interface feature are joined by a curved portion.

20. The EPS of claim 10, wherein the watertight seal extends from a location proximate a corner casting at the frame top to a location proximate one of the corner castings at the frame bottom.

21. The EPS of claim 10, wherein the second segment of the panel interface feature has an incurvation located more distally from the vertex than the interface surface, the incurvation forming a concave surface facing toward the opening.

22. The EPS of claim 21, wherein one of the inner rigid panels is coupled to the panel interface feature by a hinge located in the incurvation.

23. The EPS of claim 21, wherein in the plane transverse to the height $H_u$, the hinge mount feature, the panel interface feature and at least a portion of the tubular stiffening structure are formed of a single piece of material.

24. The multicon structure of claim 7, wherein the structure width is about 8 feet and the structure height equals about 8.0 feet, about 8.5 feet or about 9.5 feet.

25. The multicon structure of claim 24, wherein each EPS has an expanded state and wherein, in the expanded state, each EPS forms an enclosed area, and wherein for each EPS, the two sets of rigid panels are the only sets of panels that form a part of the enclosed area.

* * * * *